United States Patent [19]

Jones

[11] 4,436,011

[45] Mar. 13, 1984

[54] SLICING DEVICE FOR ROUNDED FOOD ARTICLES

[76] Inventor: Frank W. Jones, P.O. Box 4074, Greenville, Del. 19807

[21] Appl. No.: 481,764

[22] Filed: Apr. 4, 1983

[51] Int. Cl.[3] ..... B26D 1/03; B26D 4/18; B26D 4/20; B26D 7/06

[52] U.S. Cl. ..... 83/425.3; 83/437; 83/544; 83/858; 83/874; 99/537

[58] Field of Search ..... 99/537, 538, 568, 646, 99/646 S; 83/425.3, 425.2, 437, 431, 435, 544, 858, 874, 733, DIG. 1

[56] References Cited

U.S. PATENT DOCUMENTS

| | | | |
|---|---|---|---|
| 3,369,582 | 2/1968 | Giangiulio | 99/537 |
| 3,605,839 | 9/1971 | Gerson | 83/425.3 |
| 4,144,784 | 3/1979 | Jones | 83/425.3 |
| 4,184,397 | 1/1980 | Jones | 83/425.3 X |
| 4,254,678 | 3/1981 | Steiner et al. | 83/425.3 |
| 4,302,997 | 12/1981 | Jones et al. | 83/425.3 |

*Primary Examiner*—Timothy F. Simone
*Attorney, Agent, or Firm*—Charles S. Knothe

[57] ABSTRACT

A rounded food article, such as a tomato is quickly sliced into a number of slices by a manual device with a rack of parallel spaced tensioned blades mounted to the base at an acute angle. A transversing carrier assembly slides along guide rods in the base. The carrier assembly has a carrier plate and carrier fingers which are a parallel array of planor segments mounted above and parallel with the carrier plate and intermesh with the blade rack. The food article is placed on the carrier plate and carried through the blade rack by the movement of the carrier plate and fingers, thereby slicing the tomato into a number of slices. A guard mounted on the base shields the sharp edge of the blades. With the carrier in the open position the rack of blades in combination with the carrier fingers and guard creates a vertical cavity in which the food article to be sliced is inserted.

10 Claims, 10 Drawing Figures

SLICING DEVICE FOR ROUNDED FOOD ARTICLES

BACKGROUND OF THE INVENTION

Various devices have been proposed to slice soft food articles such as tomatoes. The devices described in U.S. Pat. Nos. 4,144,784, 4,184,397 4,254,678, and 4,302,997 all use a rack of stationary parallel spaced blades and a pushing device to push the food article through the blades to perform the slicing operation. In all of these devices the food article is pushed across a stationary table while being cut by the blades. The pushing of the food article across the stationary table increases the force necessary to pass the food article through the blades and in the case of soft food items such as tomatoes causes damage and distortion to the food item thus making it less aesthetically pleasing. The object of this invention is to create a food slicing device using a stationary rack of parallel spaced blades where the food article is not pushed across a stationary table but carried by a carrier plate through the cutting blades, thus eliminating the damage and distortion to the food item.

SUMMARY

Rounded food items are quickly sliced by a manual device comprising a base, a rack of parallel spaced blades mounted to the base at an acute angle with the base. The blades are under tension and have one edge sharp. A slide means is mounted to the base and a carrier assembly is mounted to the slide means on the sharp side of the blades The carrier assembly has a carrier plate connected to the slide means and carrier fingers which are a parallel array of planar segments mounted above and parallel with the carrier plate. The carrier fingers intermesh between the rack of parallel spaced blades. The carrier assembly has a range of motion which in the open position allows for inserting a food article between the rack of blades and the carrier fingers on to the carrier plate which extends beyond the lowest blade in the rack and between the lowest blade and the base. The range of motion terminates in the closed position with the carrier fingers extending through the posterior side of the blades with the carrier plate extending under the lowest blade sufficiently for the sliced food article to rest upon the carrier plate. The device has a guard mounted on the base which shields the sharp edge of the blades. With the carrier in the open position the rack of blades in combination with the carrier fingers and guard creates a vertical cavity in which the food article to be sliced is inserted. The device also has a means for inhibiting the motion of the base relative to a work surface and a locking means to secure the carrier assembly to the base.

DESCRIPTION OF PREFERRED EMBODIMENT

Figure 1:
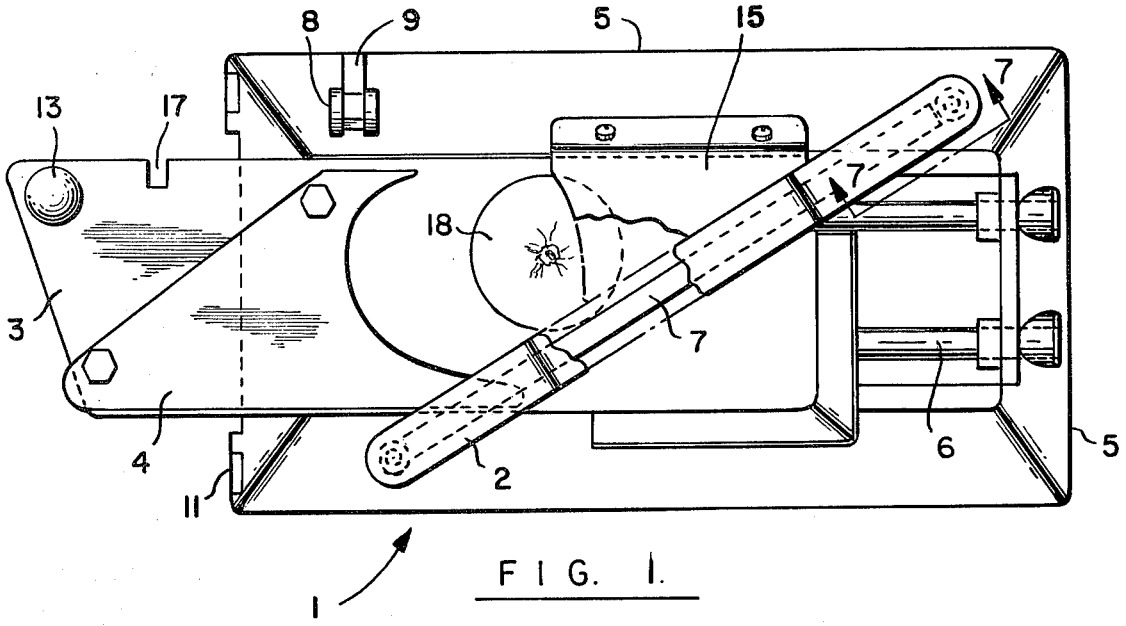
FIG. 1 is a top plan view of the invention in the open position.
Figure 6:
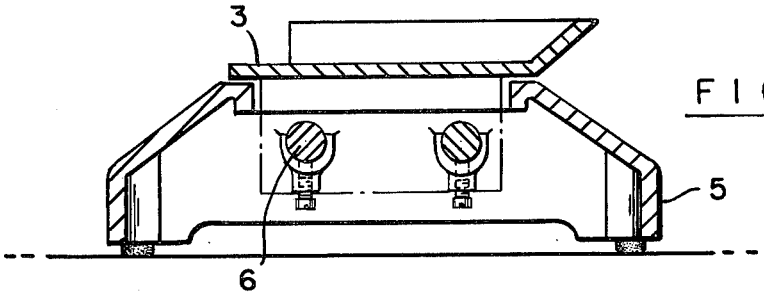
FIG. 6 is a cross sectional view of the base taken through FIG. 2 along the line 6—6.

In FIG. 1 the slicing device 1 is shown with the carrier plate 3 in the open position with a tomato 18 ready to be sliced. Mounted to carrier plate 3, which transverses on pair of slide rods 6, are the carrier fingers 4 and handle 13. Even in the open position the carrier plate extends beyond rack 2 which contains blades 7. Guard 15 mounted to base 5 rises perpendicularly from the base and then bends with a 90 degree angle to meet the rack, covering almost all the exposed blades thus shielding the operator's fingers from the sharp blades 7.

Figure 2:
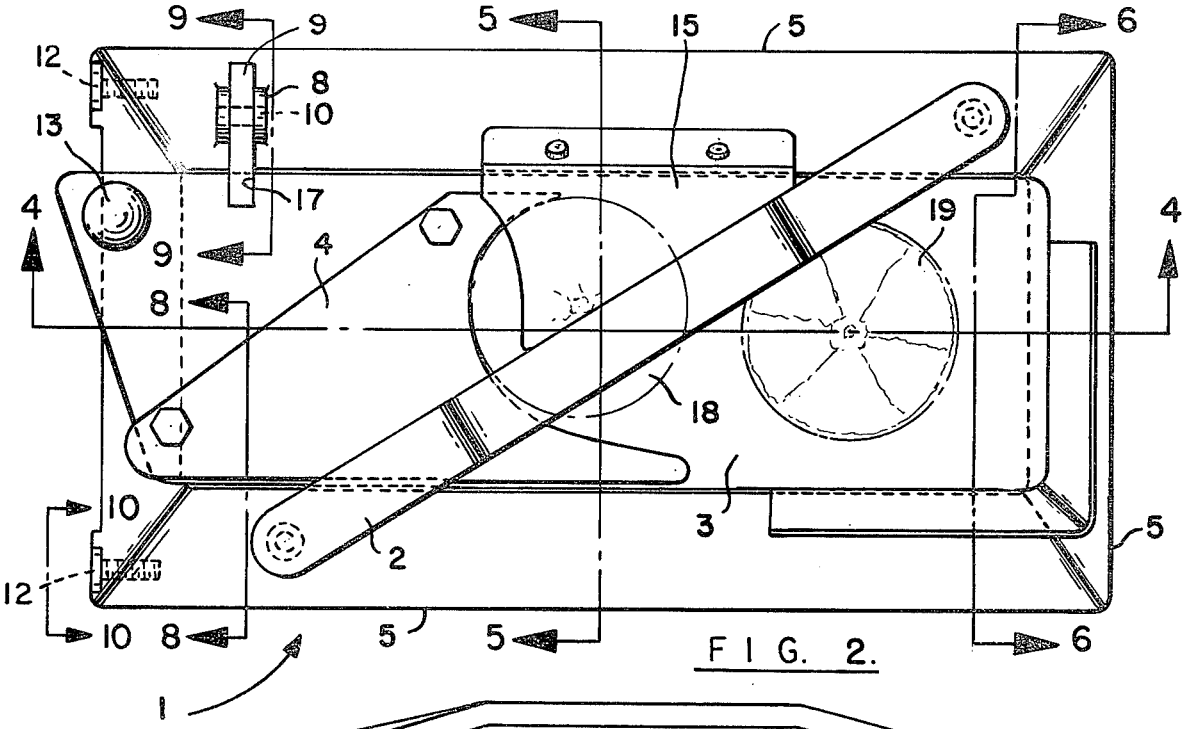
FIG. 2 is a top plan view of the invention in an intermediate position between open and closed with the slicing action of a tomato in process and showing the location of the completed sliced tomato in the phantom.

FIG. 2 shows the carrier plate 3 in an intermediate position such that the tomato 18 has transversed part way through the rack 2 in the slicing operation. The tomato is resting on the carrier plate 3 and does not move relative to the carrier plate during the entire slicing operation. The individual tomato slices are carried through the blades by the carrier fingers 4 which have a corresponding diameter as a tomato. FIG. 2 also shows part of the carrier fingers 4 exposed on the posterior side of the blade rack 2 and carrier fingers inside the guard 15. The phantom tomato 19 has been sliced and carried through the rack 2 by the carrier plate 3 and carrier fingers 4 and the slices are neatly stacked and ready to be retrieved by the operator.

Figure 7:
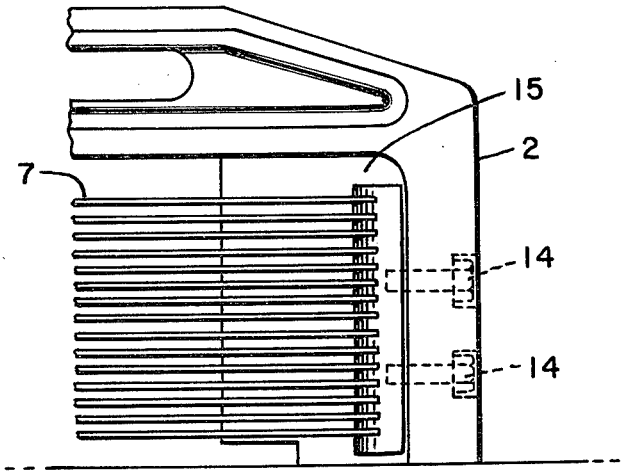
FIG. 7 is a cross-sectional view of the blade rack taken through FIG. 1 along line 7—7.
Figure 3:
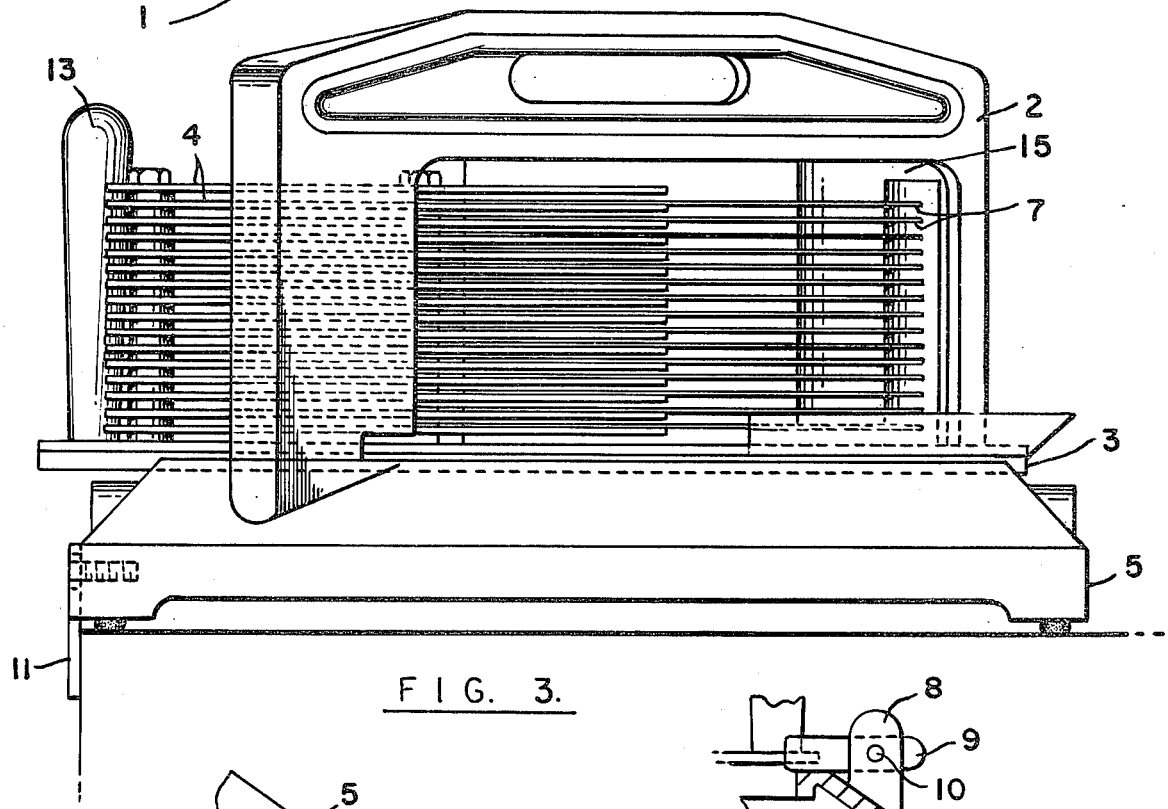
FIG. 3 is a back elevation view of the device.
Figure 4:
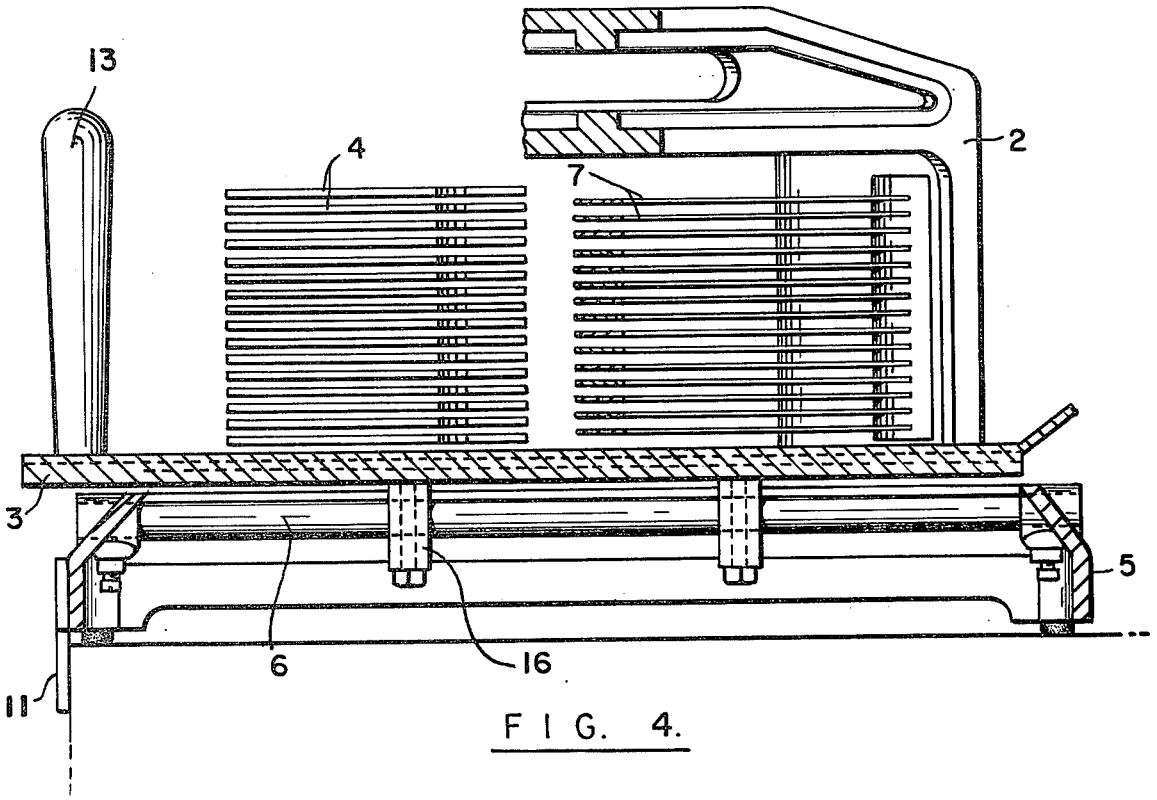
FIG. 4 is a cross sectional view of the device taken through FIG. 2 along the line 4—4.
Figure 5:
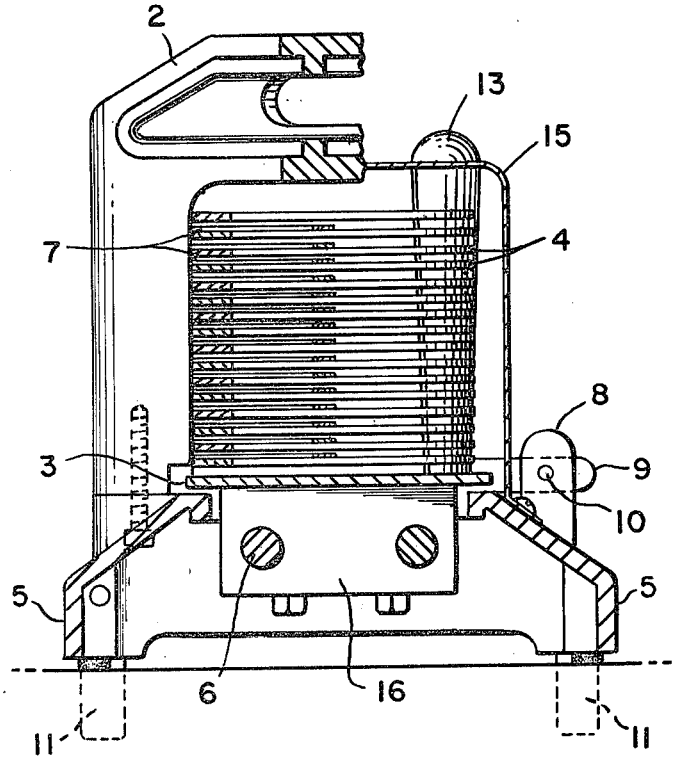
FIG. 5 is a cross sectional view taken through FIG. 2 along the line 5—5.
Figure 8:
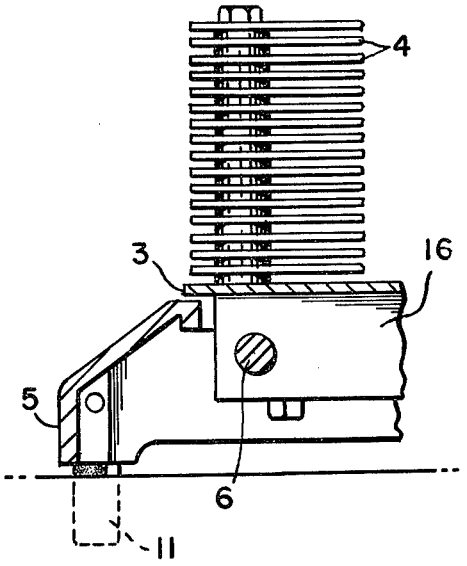
FIG. 8 is a cross-sectional view of the carrier fingers and base taken through FIG. 2 along line 8—8.

FIG. 7 shows the rack with the parallel spaced blades 7 held in tension by the rack tension bolts 14. The intermeshing of the blades 7 and the carrier finger 4 is shown in FIGS. 3-5. The carrier fingers alternate with the blades. When the carrier assembly is fully closed the carrier fingers extend slightly beyond the posterior end of the blades to insure complete slicing of the food item. Even with the carrier assembly in the open position the carrier fingers intermesh with the blades as best shown in FIG. 1.

The slide guides 6 are fixed to the base 5 and are shown in FIGS. 1, 4, 5, 6, and 8. In particular, FIG. 4 shows how the carrier plate 3 is attached to the slide guides 6 by means of four widely spaced side guide followers 16. The wide spacing allows for smooth non-jamming operation of the carrier assembly. The carrier plate is free to transverse back and forth along the slide guides 6 and is stopped by the base 5 at either end.

Figure 10:
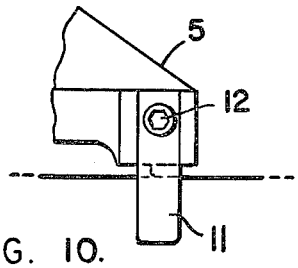
FIG. 10 is a cross-sectional view of the base and stop walk tab taken through FIG. 2 along line 10—10.
Figure 9:
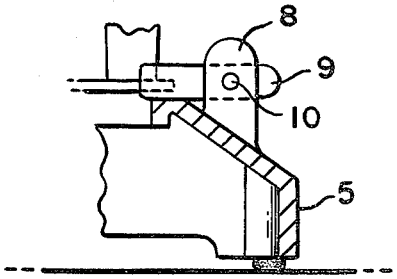
FIG. 9 is a cross-sectional view of the base and lock taken through FIG. 2 along line 9—9.

The stop-walk tab 11 is shown in FIGS. 1-5 and 8. It hangs below the work surface the device is placed on and catches the edge of the work surface. As shown in detail in FIG. 10 the stop-walk tab 11 is mounted to the base 5 by means of a threaded cap screw 12. The stop-walk tab 11 can be removed if this feature is not necessary.

The gravity biased locking lever 9 is shown in FIGS. 1, 2, 5 and 9. The locking lever pivots on lock pin 10 which is mounted in lock boss 8. The locking lever 9 interacts with locking notch 17 best shown in FIG. 1. Engaging the locker lever 9 in locking notch 17 allows transporting of the device without the carrier assembly sliding back and forth.

I claim:

1. A manual food slicer comprising a base;

a rack of parallel spaced blades mounted to said base at an acute angle with said base, said blades under tension and having two edges, one edge sharp;

a slide means mounted to the base;

a movable carrier assembly mounted to said slide means on the sharp side of the blades, said carrier assembly having a carrier plate connected to the slide means and carrier fingers which are a parallel array of planar segments mounted above and parallel with the carrier plate, said carrier fingers intermesh between the rack of parallel blades, in the open position the carrier assembly allows for inserting a food article between the rack of blades and the carrier fingers on to the carrier plate which extends beyond the lowest blade in the rack and between said lowest blade and the base, in the closed position the carrier fingers extend through the posterior side of the blades with the carrier plate extending under the lowest blade sufficiently for the sliced food article to rest upon the carrier plate, a guard mounted to the base and shielding the sharp edge of the blades and in combination with the rack of blades and the carrier fingers with the carrier assembly in the open position creating a vertical cavity in which the food article to be sliced is inserted;

a means stopping the base from moving relative to a work surface and;

a locking means to secure the carrier assembly to the base.

2. A device as set forth in claim 1 wherein the rack of blades contains 15 blades.

3. A device as set forth in claim 1 wherein the rack of blades contains 11 blades.

4. A device as set forth in claim 1 wherein the rack of blades contains 8 blades.

5. A device as set forth in claim 1 wherein the rack of blades contains 6 blades.

6. A device as set forth in claim 1 wherein the cavity formed the guard, carrier fingers and the rack of blades is approximatedly 4 inches in diameter.

7. A device as set forth in claim 1 wherein the blades are separated from each other in the range of $\frac{1}{8}$ to $\frac{1}{2}$ inch.

8. A device as set forth in claim 1 wherein the slide means are two rods from $\frac{1}{4}$ to $\frac{1}{2}$ inch in diameter.

9. A device as set forth in claim 1 wherein the means to inhibit the motion of the device relative to the work surface is a rigid tab which extends below the base.

10. A device as set forth in claim 1 wherein the means to secure the carrier assembly to the base is a gravity biased lever piviotly mounted to the base and a notch in the carreir plate which is engaged by the lever.

* * * * *